US008616939B2

(12) United States Patent
Toyama

(10) Patent No.: US 8,616,939 B2
(45) Date of Patent: Dec. 31, 2013

(54) DETACHABLE HAND SANDER WITH REPLACEABLE ABRASIVE SHEET

(76) Inventor: Roberto Kazuo Toyama, São Paulo (BR)

( * ) Notice: Subject to any disclaimer, the term of this patent is extended or adjusted under 35 U.S.C. 154(b) by 268 days.

(21) Appl. No.: 13/114,098

(22) Filed: May 24, 2011

(65) Prior Publication Data

US 2011/0287702 A1 Nov. 24, 2011

(51) Int. Cl.
*B24D 15/00* (2006.01)

(52) U.S. Cl.
USPC ..... 451/525; 451/344; 451/59

(58) Field of Classification Search
USPC ..... 451/344, 345, 520, 523–527, 557
See application file for complete search history.

(56) References Cited

U.S. PATENT DOCUMENTS

| | | | | | |
|---|---|---|---|---|---|
| 840,982 | A | * | 1/1907 | Williams | 451/492 |
| 932,879 | A | * | 8/1909 | May | 451/502 |
| 1,067,280 | A | * | 7/1913 | Smilovetz | 451/503 |
| 1,175,245 | A | * | 3/1916 | Dennis | 451/515 |
| 1,520,642 | A | * | 12/1924 | Giroux | 451/522 |
| 1,664,950 | A | * | 4/1928 | Sloan | 451/522 |
| 1,844,996 | A | * | 2/1932 | Walker | 451/503 |
| 1,858,899 | A | * | 5/1932 | Montbriand | 451/503 |
| 1,927,574 | A | * | 9/1933 | Parks | 451/515 |
| 2,112,593 | A | * | 3/1938 | Campbell | 451/502 |
| 2,457,076 | A | * | 12/1948 | Williams, Jr. et al. | 451/522 |
| 2,527,089 | A | * | 10/1950 | Adams | 451/515 |
| 2,560,008 | A | * | 7/1951 | Steward | 15/231 |
| 2,765,593 | A | * | 10/1956 | Salmon et al. | 451/518 |
| 3,089,294 | A | * | 5/1963 | Cowley | 451/524 |
| 3,410,035 | A | * | 11/1968 | Gohde | 451/523 |
| 4,930,267 | A | * | 6/1990 | Hill et al. | 451/354 |
| 5,168,672 | A | * | 12/1992 | Gregoire, Sr. | 451/502 |
| 6,267,658 | B1 | * | 7/2001 | Ali et al. | 451/523 |
| 6,296,558 | B1 | * | 10/2001 | Poole et al. | 451/557 |
| 6,688,958 | B1 | * | 2/2004 | Jones et al. | 451/557 |
| 2006/0048319 | A1 | * | 3/2006 | Morgan et al. | 15/104.94 |
| 2007/0190917 | A1 | * | 8/2007 | Hutchins | 451/530 |
| 2009/0117836 | A1 | * | 5/2009 | Ali et al. | 451/524 |

FOREIGN PATENT DOCUMENTS

GB 2074062 A * 10/1981

* cited by examiner

*Primary Examiner* — Lee D Wilson
*Assistant Examiner* — Tyrone V Hall, Jr.
(74) *Attorney, Agent, or Firm* — Ostrolenk Faber LLP

(57) ABSTRACT

The present invention refers to a constructive disposal in hand sander, more specifically, a hand sander with refill system for exchange of sandpaper sheet suitable for finishing operations and removal of excess material, for thinning of wall surfaces, wood, metal, etc.

5 Claims, 11 Drawing Sheets

DETACHABLE HAND SANDER WITH REPLACEABLE ABRASIVE SHEET

CROSS-REFERENCE TO RELATED APPLICATIONS

This application claims benefit of Brazilian Utility Model MU9000778-6, filed May 24, 2010.

BACKGROUND OF THE INVENTION

The present invention refers to a constructive disposal in hand sander, more specifically, a hand sander with refill system for exchange of sandpaper sheet suitable for finishing operations and removal of excess material, for thinning of wall surfaces, wood, metal, etc.

1. Prior Arts

Are present and therefore are already well known in the prior art, hand sanders having a system that allows the exchange of sandpaper sheet, usually consisting of two parts, one provided with cable or strap so that the piece can be hold by the user and the other part directed for fastening the sandpaper sheet. In most cases these parts are joined together forming a single piece, where the outer top is protruded with an catcher type, usually a strap allowing the user to hold the piece, and the bottom outwardly opposite to that strap or cable which is allocated the sand-paper enabling the process of hand sanding.

2. Troubles of the Prior Art

The fastening system widely used to join the two parts of the device referenced herein as well as the fastening system that joins the part which supports the sandpaper sheet become the operation slow and complex since usually is used the fitting process by cracks, for fastening elements or screws. This provide to the user several problems regarding the reliability of the fastening the top at the bottom or in relation to the security of the fastening the sandpaper sheet in the support base.

The patent application P19103694 filed in the name of Queila Contage Teixeira describe a hand sander having one support part, one coat part or cap supplied with longitudinal garnishes where the two parties have concavity recess disposed centrally and having a central hole for inserting one fastening element or screws. The part of the cap is endowed with one strap directed to facilitate the attaching of the sander during the sanding operations.

The disposal is provided in order to allow to catch between the top surface hold and the coat or cap, the rectangle of sandpaper which cover the bottom surface and the longitudinal face of hold and has their ends fixes catches between the hold and coat. The hand sander according to the invention can be rectangular or sharpened in direction to the ends in order to provide ends that faciliates sanding operations in sharp edges.

The first trouble found in this invention, refers to its fastening method. Whereas a sandpaper sheet has a very short useful life, i.e., it has to be replaced several times during the work, and considering that such a substitution requires that there is the necessary tools so that the sandpaper sheet is unleashed the part that holds, the user of this object would take considerable time to conduct this procedure.

Moreover, the fact of fastening the abrasive sheet to be performed only in the central part of the device makes the same in response to pressure exerted by the user in a circular movement or a straight back-to-face or vice versa usual in the sanding process surfaces, moving in the peripherical region of its support base since that the fastening point is confined to its central region.

The loss of abrasive material at the peripherical region of the sheet due to deterioration occurred by displacement of it, makes the product can not perform its function in the field of coverage as expected.

3. Problems to be Solved by the Invention

It is a purpose of the present improvement to solve the above-mentioned troubles and improve functioning of the device manual sander hitherto known.

So with this intention, the hand sander object of this improvement has been constructed to allow the sandpaper sheet to remain reliably fixed in position of use so as to allow the use of it throughout its length avoiding waste.

This happens because the hand sander, object of this improvement is made of two parts which join together properly to hold the sandpaper sheet proving secure fastening.

This device, object of this application is showed in parallelepiped shape can be constructed in a only form or the joint of two parts, namely an upper body and lower body. The bodies, top and bottom are joined by the juxtaposition of their respective inner surfaces facing each other, which are covered in a blanket made up of hooks and loops, available in the market by the trademark Velcro® hereinafter fastening connector.

This improvement device of hand sander can take several configurations, noting that such descriptions should be understood by the examples but not limited, since other shapes and arrangements can configure this improvement without escaping the protectional scope claimed in the utility model presented here.

Specifically the purpose of the present improvement is to provide the following device of hand sander.

In a first aspect, the device of the present improvement includes an upper body having a portion of upper surface with slightly rounded edges followed by a middle portion formed by a recessing track which surrounds the external extension of that parallelepiped body, providing an anatomical shape suitable to be safe and comfortably handled by the user without need for effort aper.

Such recessing track is followed by a basis on which the opposing side ends thereof are thinner than the central part that is more thick to convexly fit with the hole of the central part opposite to the lower portion of such device. This format provides an hermetic fit between the upper portion of the device with the lower portion of the device which are also provided in their inner parts opposed to each other by a blanket-type Velcro® that works as a connector of fastening the sandpaper sheet to be disposed between those parties.

This lower portion has straight edges increasing the range of the sandpaper sheet on the surface to be operated differently from the upper portion of the upper body that comes in a rounded shape so that the user experiences a comfortable feeling at the time of use. As this upper body will be taken by the hand to the user, will be henceforth referred to as catcher body. Since the lower body of the hand sander, which will have the function to retain the sandpaper sheet showing his abrasive side on the outside, will henceforth be called as sander body.

In a second preferred aspect of this improvement, the upper portion of catcher body assumes a curved shape having in its bottom central part a protuberance to fit with the central portion opposite the sander body that has a recess able to receive the protruding portion disposed in the central catcher body, providing a fitting convex portion of the catcher body with concave portion of the sander body.

In this aspect the preferred catcher body and sander body are two individual parts which joined in the fitting process described above and are fixed through the same fastening connector previous described.
for fixing the above.

In the third aspect of this improvement, the device is configured by a single part defined by a partial cut in the transversal ends in the longitudinal and horizontal lateral openings disposed at opposite ends of the unitary body covered inside by the Velcro® type fastening connector able to receive and fix the sandpaper sheet for its opposite ends providing its abrasive part on the outside of the lower portion of such unit device.

Further in the fourth preferred aspect, this improvement has to be composed of two distinct parts with identical external dimensions and the upper surface of the catcher body has a slightly rounded shape at its ends to give the user a comfortable feeling in the moment of its handling, since sharp corners would cause discomfort to the user and even scarring once the sanding process requires the detachment of the physical force of device against the work object.

In the present configuration the middle part of both bodies, the catcher body and sander body funneled to their conflict internal parts and are assuming a waisted molded in "U" where still present coated with the fastening connector so that they can receive the sandpaper sheet and reliably keep it stuck between the two parties. Such format "U" obtained by the union of two bodies serve also to anatomically to hold the said device providing it has a smaller thickness and lighter in turn indicated for procedures that require a more delicate procedure.

And further this fifth preferred aspect, this improvement is constituted of the catcher body has a thickness thicker than that shown by the sander body, and so the catcher body is constituted by a recessed track disposed in order to be secure by the user. Contrarily, it is composed of a thinner thickness body shows the sander body. Here also the sandpaper sheet around the outside of the lower part of the sander body being trapped between the two bodies and on the other hand allowing that the abrasive part keep facing the outside of the device, and therefore in a position to execute.

Such improvement offers the possibility to fix the sandpaper sheet in a device like a hand sander without the need for handling fastening screws, or any other type of fitting in order to be guarantee for the immobilization of the sandpaper sheet, which certainly brings inconvenient to the user.

With the fastening system for connector consisted of hooks and loops the user can proceed with the change of sandpaper sheets as often as necessary unless it is required more than 1 minute in this execution, since for such a procedure does not require a specific tooling, attention and time needed to perform this activity. So that the sandpaper sheet is appropriate to make compose such device must have the fastening means with proposals of quickness and easiness.

Some variations of the fastening means which can be applied on an industrial scale at low cost have been tested out to be appropriate for that function.

One of the preferred embodiment to provide the fastening means of such sandpaper sheet in the hand sander is through the production of holes positioned in the border of such sandpaper sheet which can be disposed in parallel lines each side by side as well as can take over other visual that will develop appropriately the same function.

In this preferred embodiment the position of the holes enable the intersection of the layer of the connector consisted of hooks and loops that are in the surface of each body being positioned facing each other working as fastening connector of the sandpaper sheet in such device.

The effectiveness of fastening of the sandpaper sheet retained between the upper body and lower body through Velcro fastening connector presents on the surfaces of each of that body becomes even more satisfying since the external force exerted by the user of hand sander compresses more the two bodies among themselves, and the same against the object to be worked.

In the case of hand sander is present in a only way, the same process is carried out between the device and said object work ensuring the permanence of that sandpaper into the device so reliably safe during the execution of this procedure. The manner of fastening of the sandpaper sheet on the device, object of this improvement is not limited to disposal of holes arranged in sequential and parallel lines, provided that this suggestion be understood in its character of illustration and not restrictive, since the intention is to give the user the possibility of making use of sandpaper sheets commonly sold on the market.

Further is a preferred aspect of this improvement the fact that it is appropriate to the performance of this hand sander any sander available to consumers which will considerable reduce the costs for acquiring such device.

A sandpaper sheet can take various configurations to adapt to the fastening means available in this utility model.

The first preferred embodiment of adaptation and fastening to the hand sander is through the intersection of the inside of the upper body with the inside of the lower body of the hand sander that can occur by means of round holes arranged at opposite ends of the sandpaper sheet enabling the joint of the upper to the lower;

The objectives and other aspects of the invention can be easily understood with reference to the drawings attached herein and shall be elucidated so as illustrative form, not limited, in which.

Detailed description of preferred embodiments according to the drawings, will be showing below.

The following improvements will be fully understood according to the explanations given to the accompanying drawings, which should be interpreted in a illustrative and not exhaustive way.

In a first aspect of the device, object of this improvement to the hand sander (1) includes an upper body hereinafter catcher body (2) which has a portion of the upper surface with slightly rounded ends followed by a middle portion formed by reentrant which surrounds the external extension of that parallelepiped body, providing an anatomical shape suitable to be safe and comfortably handled by the user without the need for tightening effort.

The internal base of the reentrant band of the catcher body (2*a*) has paper feeder resulting from the lowering of its ends (2*b*, 2*b*) compared to the profile of the catcher body (2) followed by central protuberance disposed convexly in the center of the concave inner base (3*a*) of the sander body (3) that still has protuberant paper feeder (3*b*, 3*b*) allowing a hermetic groove for juxtaposition process of bodies contrary opposites.

Figure 1:
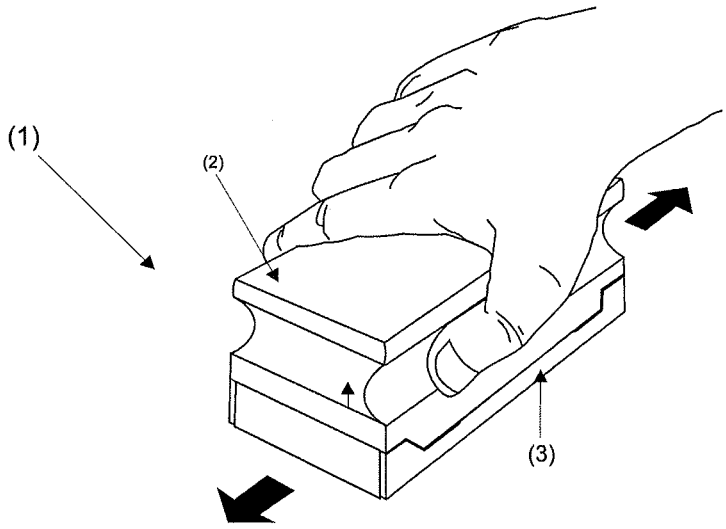
FIG. 1 is a perspective view of the hand sander of the first embodiment in a use position containing a sandpaper sheet mounted between the lower and upper bodies.
Figure 2:
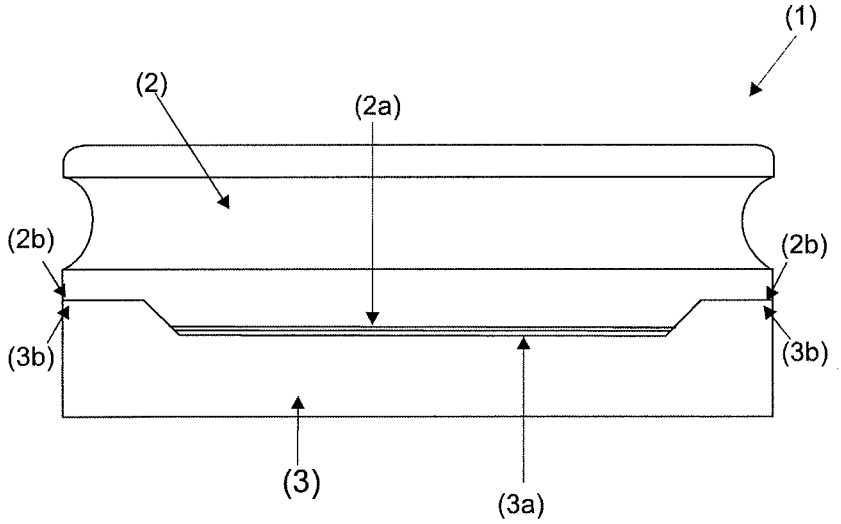
FIG. 2 is a side view of the hand sander in use position, without the sandpaper sheet of the first embodiment.
Figure 3:
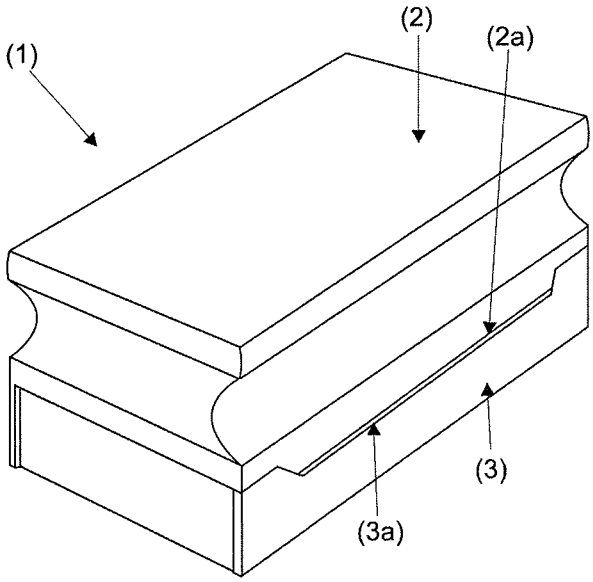
FIG. 3 is a perspective view of the hand sander in use position, without the sandpaper sheet and the identification of paper feeders and shoulder to a sandpaper sheet of the first embodiment.

The inner central parts (2*a*) and (3*a*) of the catcher body (2) and sander body (3), respectively, are covered with a blanket of Velcro® type fastening connector, arranged to receive the sandpaper sheet (5) extend externally around the sander body (3) throwing its ends lateral opposite on the inner part (3*a*, 3*a*) of said sander body (3) subjected to pressure practice by base centrally opposite (2*a*, 2*a*) of the catcher body (2) allowing for the fitting of both bodies (2, 3) to keep the sandpaper sheet (5) fixed between them, featuring the hand sander (1) ready for use as shown in FIG. 3.

Figure 4:
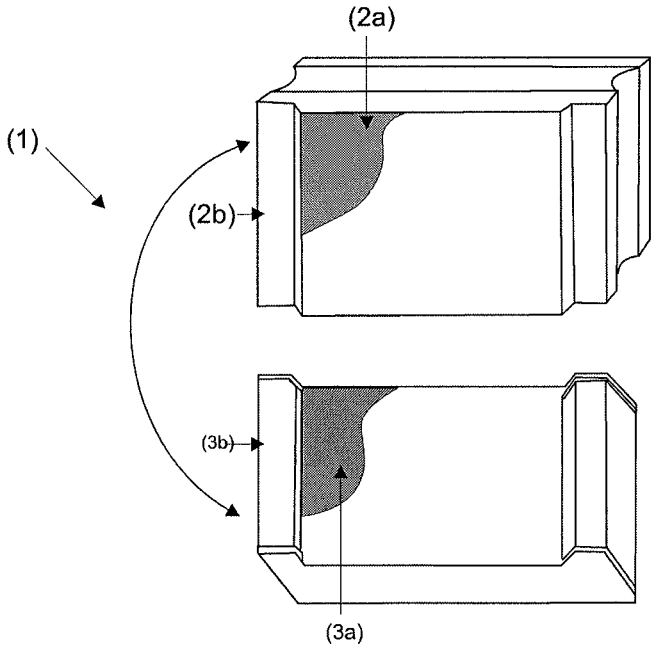
FIG. 4 is an elevation view showing in perspective the upper body and lower body of the hand sander disconnected from their inner parts face up evidencing partially the fastening connector, i.e., a Velcro® blanket that covers the interior of these parts, and the paper feeders and the shoulder of groove and fastening of the sandpaper sheet in accordance with the first embodiment.

FIG. 4 is a top view of the inner parts (2*a*, 3*a*) of the hand sander (1) with the catcher body (2) evidencing their paper feeder lowered (2*b*) as well as the protuberant paper feed (3*b*) of the fastening body (3). The double arrow indicates the movement to be executed in the process of fitting the bodies (2, 3).

Figure 5:
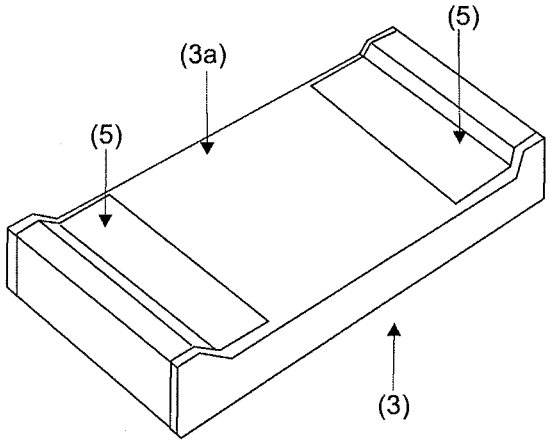
FIG. 5 is a higher perspective view showing the sandpaper sheet placed on the inside of the lower body, ready to receive the upper body of the catcher body of the first embodiment.

FIG. 5 shows the fastening body (3) evidencing its inner part (3*a*) covered by the fastening connector receiving a sandpaper sheet (5) with their respective opposite side ends throwed on the protuberant paper feeder (3*b*, 3*b*).

Figure 6:
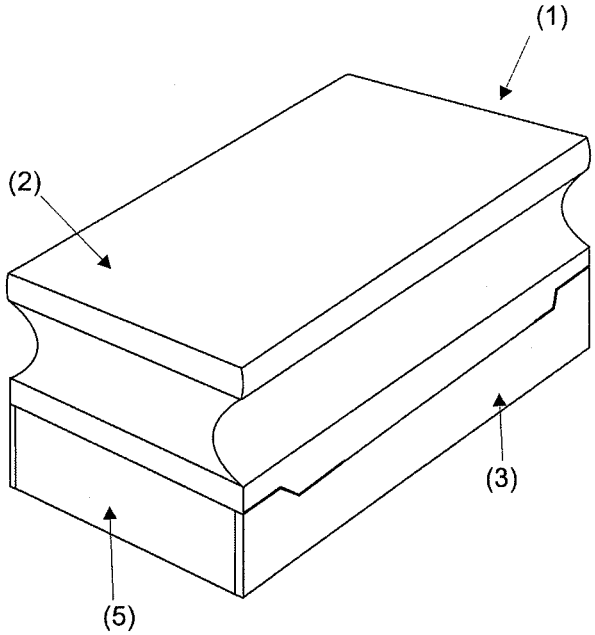
FIG. 6 is a view of the hand sander of the embodiment 1, in a use state.

FIG. 6 shows the hand sander (1) with the catcher body (2) and fastening body (3) fitted with a sandpaper sheet (5) properly attached between the two bodies (2, 3) in use position.

Figure 7:
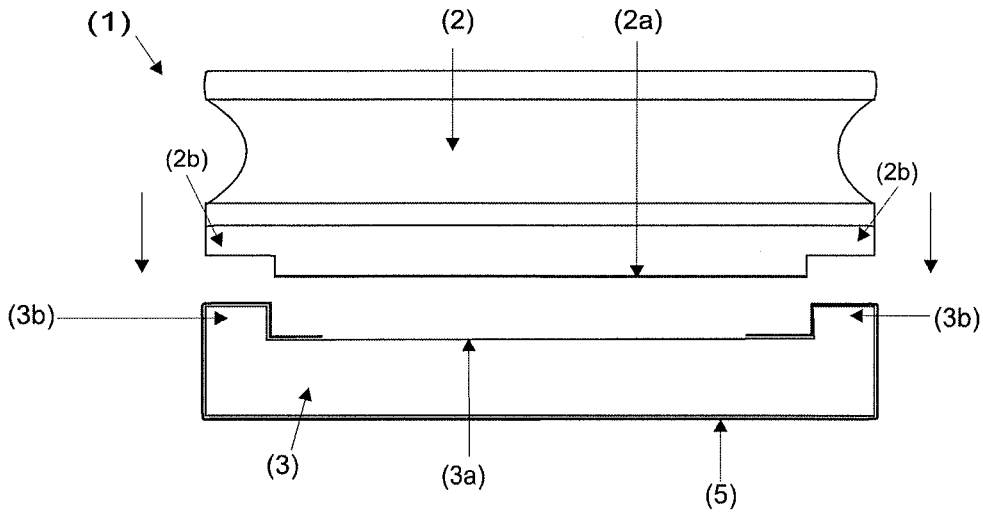
FIG. 7 is a side view of the sander of the embodiment 1 in a disjointed position showing the paper feeder and grooves shoulder of catcher and sander bodies ready to connect and fix the sandpaper sheet wrapped the sander body.

FIG. 7 is a side view of the hand sander (1) with the catcher body (2) separate from the sander body (3) evidencing the sandpaper sheet (5) overlap on the sander body (3), while the bodies (2, 3) ready to be slotted through a juxtaposition process of the marginal parts (2*b*, 2*b*) and (3*b*, 3*b*).

Figure 8:
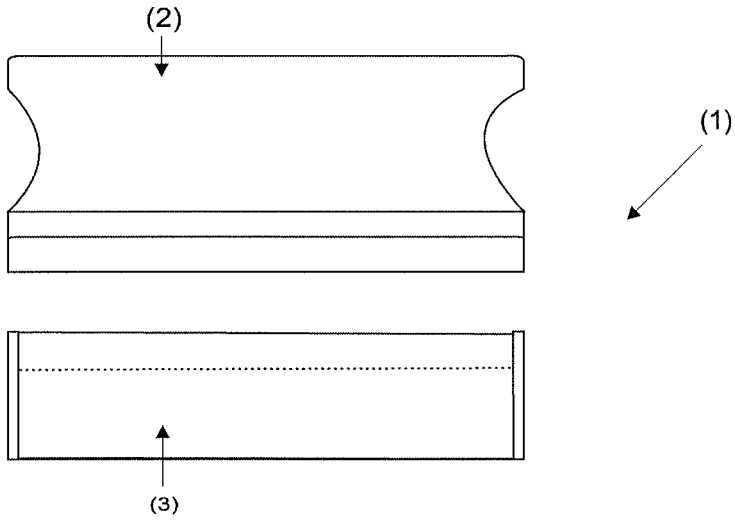
FIG. 8 is a frontal view according to FIG. 7.

FIG. 8 is a front view of the hand sander (1) with the bodies, catcher and sander (2, 3) are in a position of ready for fitting.

Figure 9:
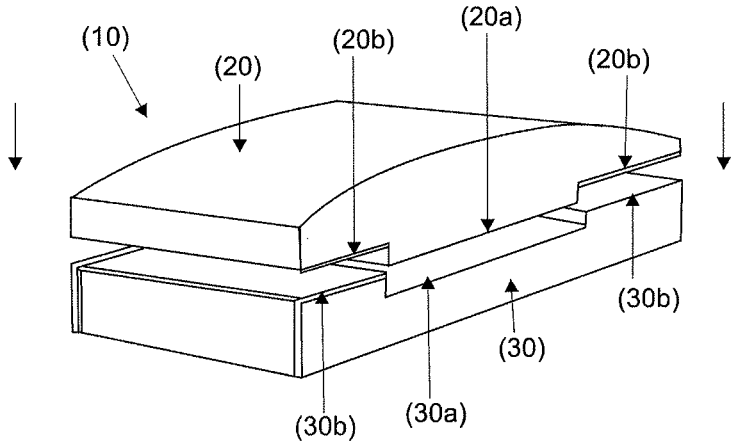
FIG. 9 is a perspective view showing the hand sander according to the second preferred embodiment of this disconnected improvement.

FIG. 9 is a perspective view of the hand sander (10) according to the second preferred embodiment of this improvement in a position ready for fitting, where the catcher body (20) shows with its curved profile and its protuberant central part (20*a*) and reentrant paper feeder (20*b*, 20*b*) to allow the fitting with the sander body (30) through its reentrant central part (30*a*) and protuberant paper feeder (30*b*, 30*b*).

Figure 10:
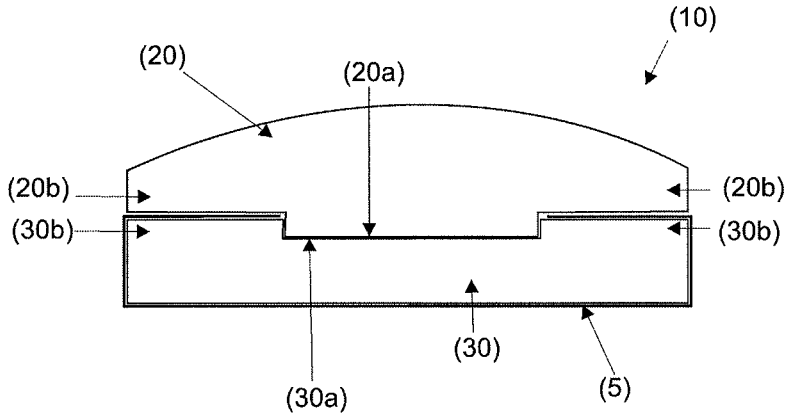
FIG. 10 is a side view according to FIG. 9 in a position of connection and ready for use.

FIG. 10 is a side view of such hand sander (10) with a sandpaper sheet (5) properly fixed between the catcher body and sander body (20, 30) in use position, where opposing arrows indicate the contrary movement of the fitting.

Figure 11:
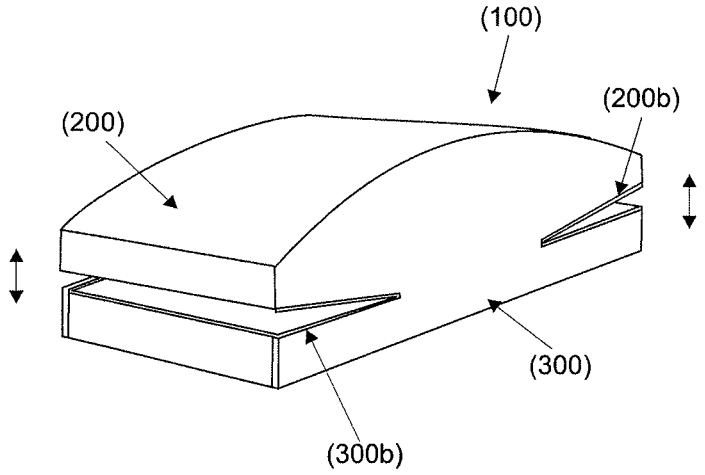
FIG. 11 is a perspective view showing the hand sander type alone flexible piece according to the third preferred embodiment of this improvement with the reception and fastening flaps open to receive the sandpaper sheet.

FIG. 11 is a perspective view of the hand sander (100) according to the third preferred embodiment of this improvement where the catcher body (200) and sander body (300) are connected together in their central parts forming a single device, where its opposite lateral ends (200*b*, 300*b*) are designed to receive the sandpaper sheet (5).

Figure 12:
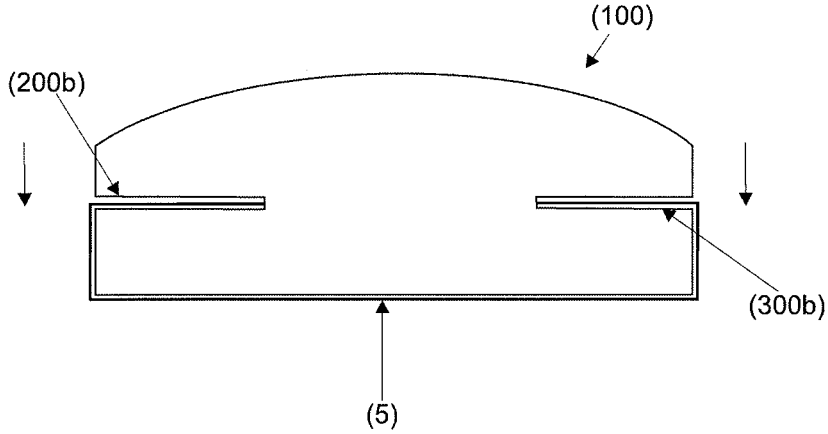
FIG. 12 is a side view of the hand sander in accordance with FIG. 11 in use position.

FIG. 12 is a front view of the hand sander (100) with a sandpaper sheet (5) it fixed in a use position.

Figure 13:
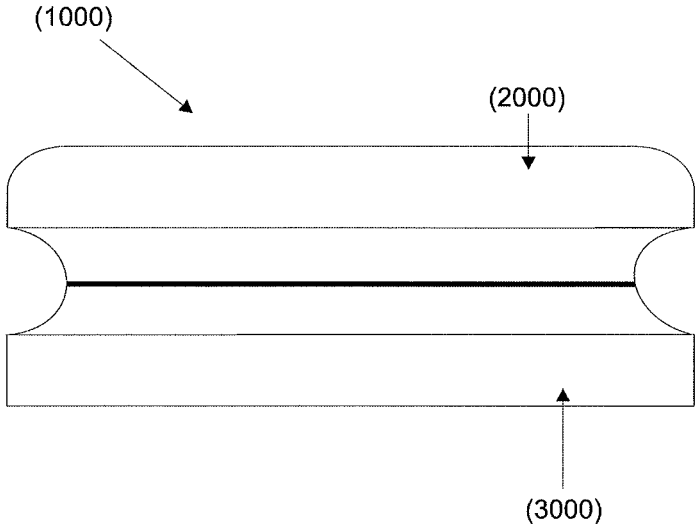
FIG. 13 is a side view of the hand sander according to the fourth preferred embodiment of this improvement in use position.

FIG. 13 is a side view according to the fourth configuration of the hand sander (1000) in use position where the catcher body (2000) and sander body (3000) are designed with the same dimensions and shapes.

Figure 14:
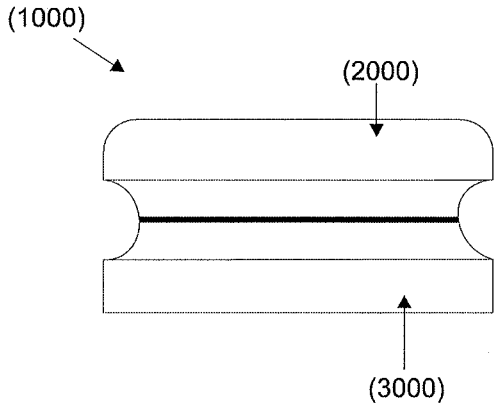
FIG. 14 is a front view of the hand sander in accordance with FIG. 13.

FIG. 14 is a front view of the hand sander (1000) being in a use position being the bodies, catcher and sander (2000, 3000) interconnected with each other.

Figure 15:
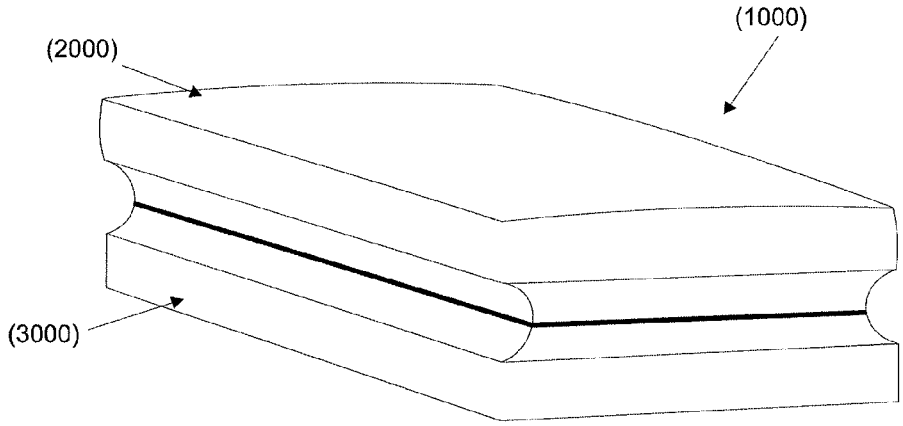
FIG. 15 is a perspective view of the hand sander in use position according to FIG. 13.

FIG. 15 is a perspective view of the hand sander (1000) in use position.

Figure 16:
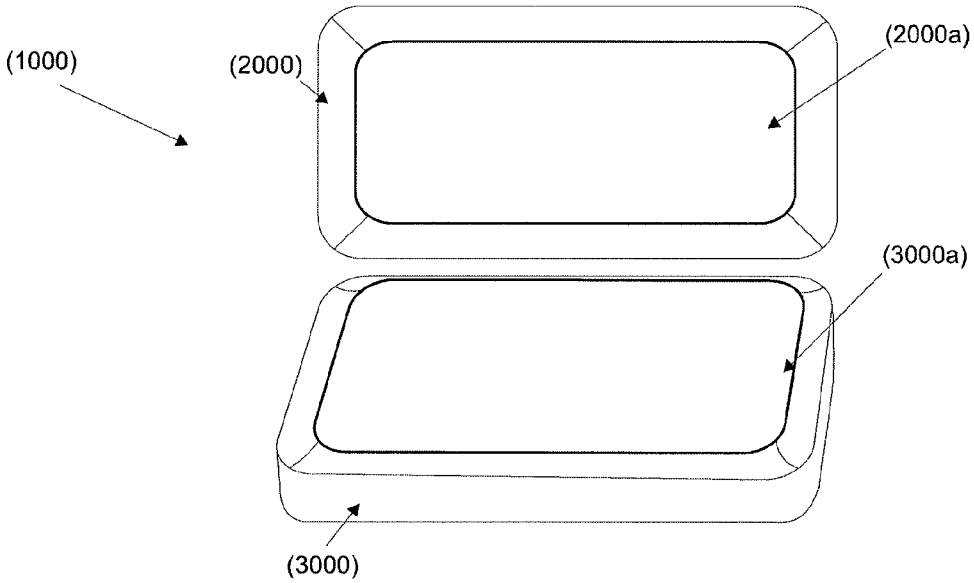
FIG. 16 is a view of the hand sander with the upper and lower bodies disconnected showing its internal parts covered by the fastening connector according to FIG. 13.

FIG. 16 is a top perspective view of the hand sander (1000) with the internal parts (2000*a*, 3000*a*) of the catcher body and sander body (2000, 3000) disconnected.

Figure 17:
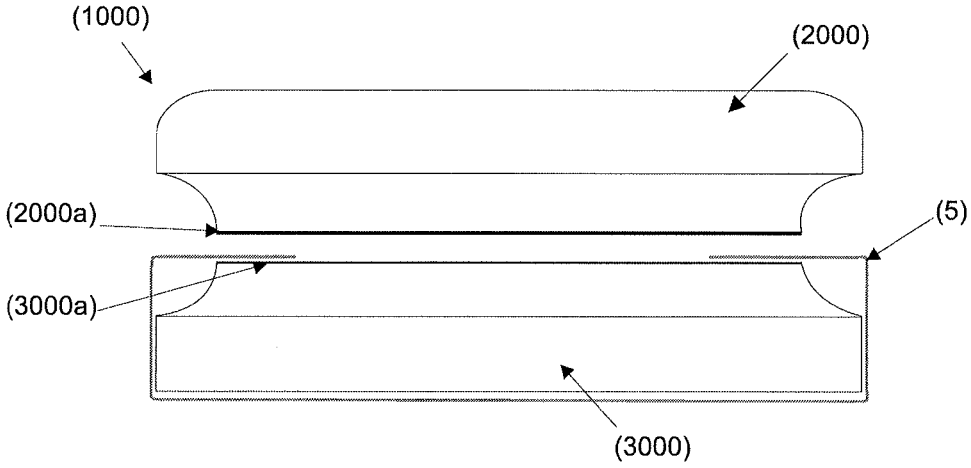
FIG. 17 is a side view of the hand sander according to the FIG. 13 with the bodies ready to come together and fix the sandpaper sheet inside them.

FIG. 17 is a side view of the hand sander (1000) with the internal parts (2000*a*, 3000*a*) of the catcher body and sander body (2000, 3000) in a position for ready connection with the sandpaper sheet (5) disposed between the same.

Figure 18:
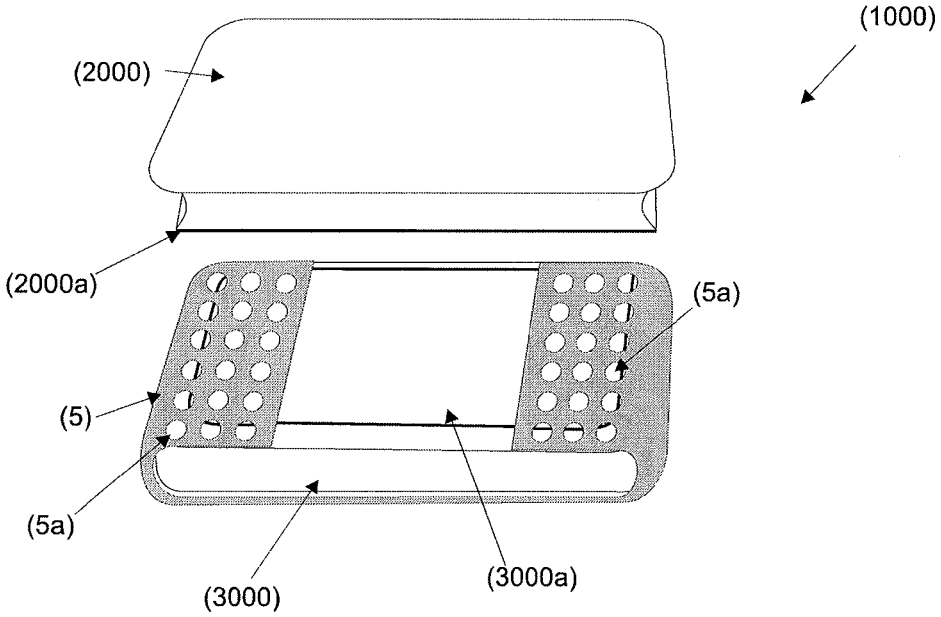
FIG. 18 is a perspective view showing the upper body disconnected in the previous slot position, showing the sandpaper sheet flat on the sander body according to FIG. 13.

FIG. 18 is a top view of the hand sander (1000) with the internal parts (2000*a*, 3000*a*) of the catcher body and sander body (2000, 3000) disconnected, where the sandpaper (5) showing with holes (the 5*a*, 5*a*) disposed in their ends parallel opposed to allow the intersection of the fastening connector that covers the surfaces of those internal parts (2000*a*, 3000*a*) to keep fixed the sandpaper sheet (5).

Figure 19:
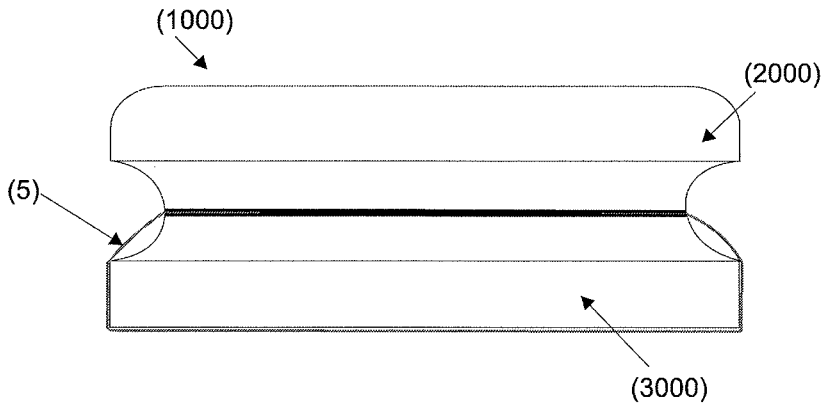
FIG. 19 is a side view of the hand sander in accordance with FIG. 13 in use position.

FIG. 19 is a side view of the hand sander (1000) in a use position.

Figure 20:
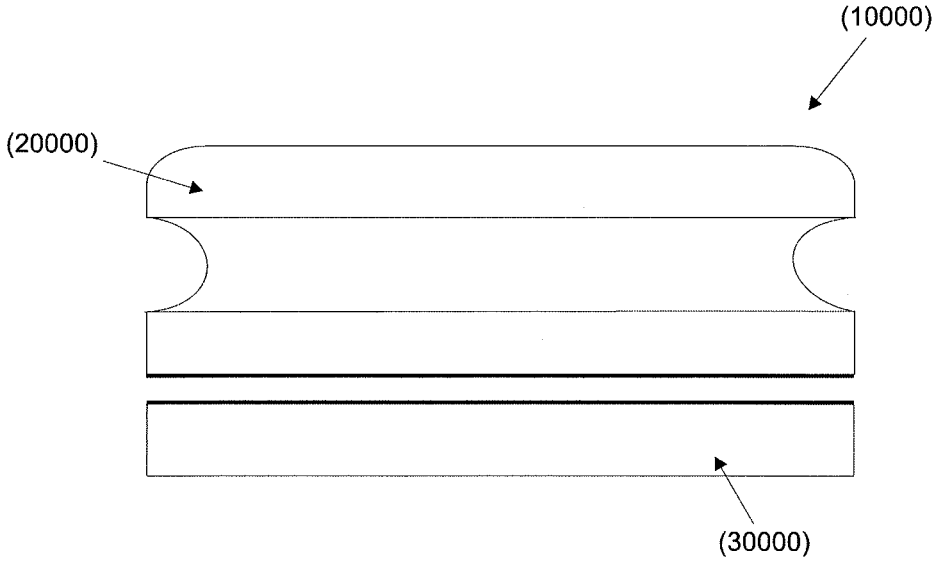
FIG. 20 is a side view of the hand sander according to the fifth preferred embodiment of this improvement with the disconnected parts.
Figure 21:
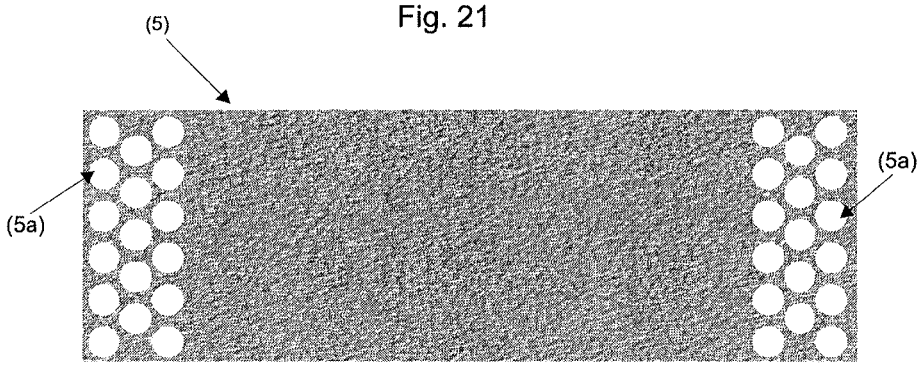
FIGS. 21 through 24 are preferred embodiments of the sandpaper sheet (Fillers) cut and adapted to the fastening system of the hand sander through holes or opened gaps on their surfaces at the fastening ends between the catcher and the sander bodies.
Figure 22:
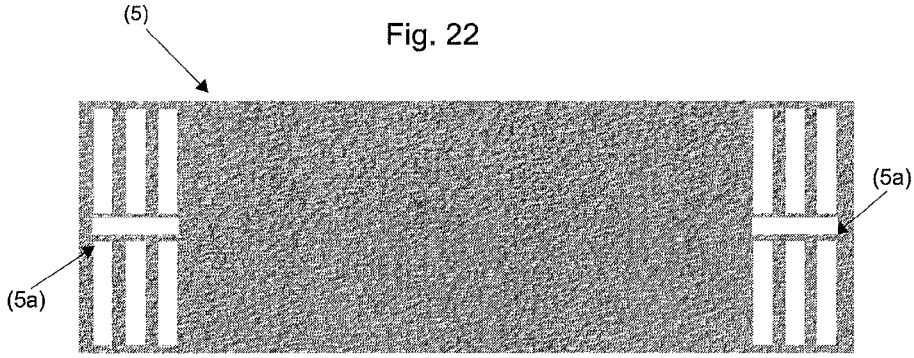
Figure 23:
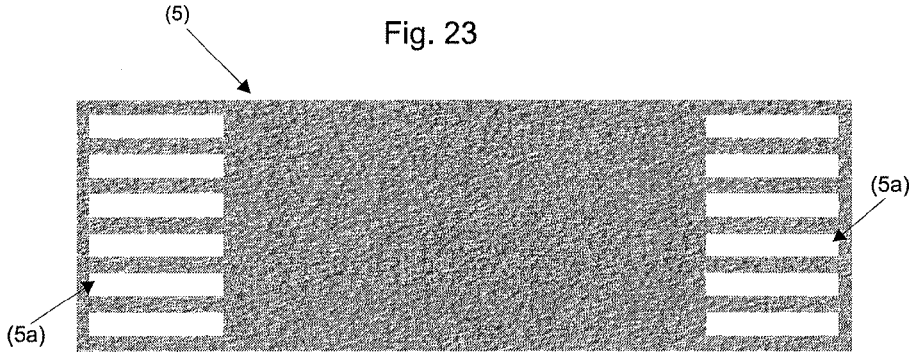
Figure 24:
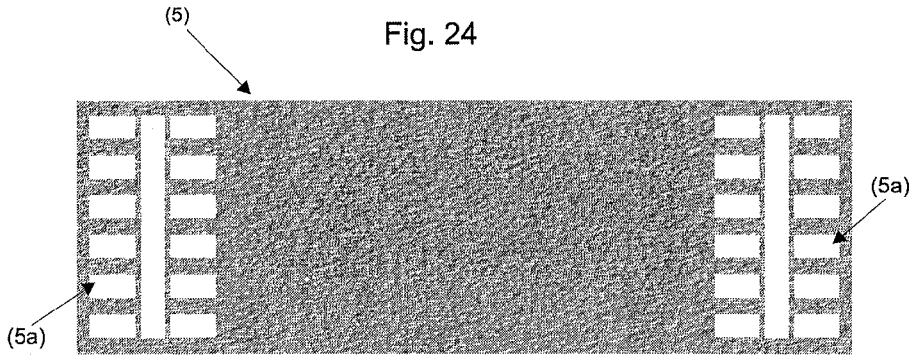

FIG. 20 is a side view of the hand sander (10000) according to the fifth configuration of that improvement with the catcher body (20000) designed to have a thickness greater than the fastener body (30000) being disconnected both bodies ready to receive the sandpaper sheet (5).

FIGS. 21-24 are variations of the sandpaper sheet designed to have at their side opposite ends, gaps, holes or similar allowing a point of intersection between the catcher body and sander body through the fastening connector lining its internal parts.

Concerning the various referred models the upper and lower parts may also take other shapes, not shown here, but that should not be discarded from the scope of this application, such as the inside of the upper body may take on a central concave form while the inner core of the lower body having a convex shape helps safety fastening of the sandpaper sheet when inserted into the inner part thereof and compressed by juxtaposition of the top and bottom bodies.

The sandpaper sheet for this improvement warrants significant savings to the user of that equipment machine since its manufacture can be conducted on an high industrial scale at very low prices, changing the parameters of the current market.

The invention claimed is:

1. A hand sander comprising an upper catcher body, a lower portion sander body, a sandpaper sheet, a hook and loop type fastener comprising a first portion residing on a surface of the catcher body and a second portion residing on a surface of the sander body opposite the first portion, the hook and loop type fastener connecting the catcher body to the sander body, wherein the sandpaper sheet includes a first plurality of perforations along one edge thereof, and a second plurality of perforations along another edge thereof opposite the one edge thereof, the first plurality of perforations and the second plurality of perforations residing between the first portion and the second portion of the hook and loop fastener, and the first portion and the second portion are fastened to one another through the first plurality of perforations and through the second plurality of perforations.

2. A hand sander according to claim 1, wherein the first and the second perforations are circular.

3. A hand sander according to claim 1, wherein the first and the second perforations are rectangular.

4. A hand sander according to claim 3, wherein the rectangular perforations are parallel to one another.

5. A hand sander according to claim 3, wherein the rectangular perforations are transversely oriented relative to one another.

* * * * *

UNITED STATES PATENT AND TRADEMARK OFFICE

CERTIFICATE OF CORRECTION

PATENT NO. : 8,616,939 B2
APPLICATION NO. : 13/114098
DATED : December 31, 2013
INVENTOR(S) : Roberto Kazuo Toyama It is certified that error appears in the above-identified patent and that said Letters Patent is hereby corrected as shown below:

On the title page insert item (30),

--(30) Foreign Application Priority Data

May 24, 2010 [BR] Brazil .....MU9000778-6--

Signed and Sealed this
Twenty-ninth Day of April, 2014

Michelle K. Lee

Michelle K. Lee
*Deputy Director of the United States Patent and Trademark Office*